US006504464B2

(12) United States Patent
Komiya

(10) Patent No.: US 6,504,464 B2
(45) Date of Patent: Jan. 7, 2003

(54) CHOKE COIL

(76) Inventor: Kunifumi Komiya, 12-8-202, Sugita 2-chome, Isogo-ku, Yokohama-shi, Kanagawa (JP)

( * ) Notice: Subject to any disclaimer, the term of this patent is extended or adjusted under 35 U.S.C. 154(b) by 46 days.

(21) Appl. No.: 09/852,632

(22) Filed: May 11, 2001

(65) Prior Publication Data

US 2002/0101319 A1 Aug. 1, 2002

(30) Foreign Application Priority Data

Dec. 20, 2000 (JP) ..... 2000-386964

(51) Int. Cl.[7] ..... H01F 38/20
(52) U.S. Cl. ..... 336/174; 336/175; 336/233
(58) Field of Search ..... 336/174, 175, 336/182, 173, 233, 212

(56) References Cited

U.S. PATENT DOCUMENTS

| | | | | | |
|---|---|---|---|---|---|
| 5,262,745 | A | * | 11/1993 | Gutierrez | 336/192 |
| 6,094,109 | A | * | 7/2000 | Greene et al. | 333/181 |
| 6,121,857 | A | * | 9/2000 | Huang | 333/172 |
| 6,233,834 | B1 | * | 5/2001 | Walsh | 33/1 PT |
| 6,339,364 | B1 | * | 1/2002 | Reddy et al. | 333/181 |

* cited by examiner

*Primary Examiner*—Anh Mai
(74) *Attorney, Agent, or Firm*—Lowe Hauptman Gilman & Berner, LLP

(57) ABSTRACT

A choke coil is provided with a coil formed of a conducting wire covered by an insulating coating and wound in a coil shape; a conducting ring provided one on both ends of the coil; and a bar-shaped core formed of ferrite, ceramic, or the like and penetrating the coil. The ring has a prescribed width and has a centerline extending in the axial direction of the core.

5 Claims, 4 Drawing Sheets

CHOKE COIL

BACKGROUND OF THE INVENTION

1. Field of the Invention

The present invention relates to a choke coil mounted on a printed circuit board, for example, and particularly to a choke coil suitable for high-frequency uses.

2. Description of the Related Art

Choke coils are generally mounted in large numbers in high-frequency printed circuit boards and the like of electronic equipment. These choke coils are used for a wide variety of purposes and are manufactured in various constructions depending on their intended use.

However, choke coils alone cannot be used in broadband circuits covering a range from low frequencies to microwave bands because the Q-value of the coil rises too high. Therefore, resistors and the like are conventionally connected to the choke coils in order to maintain a suitable Q-value.

In recent years, however, electronic equipment has become smaller and more lightweight at a rapid pace, requiring that electronic parts be mounted at a higher density on the printed circuit board. When mounting a plurality of the conventional choke coils described above on a printed circuit board, therefore, it is necessary to connect them close together in series. With this configuration, neighboring choke coils may become magnetically coupled due to leakage flux between choke coils (magnetic flux near the ends of the choke coils). This causes the resonance frequency to shift toward the low frequency end, preventing the choke coils from performing their intended function.

When choke coils are mounted on a printed circuit board to eliminate noise or the like from the power terminals of operational amplifiers connected in multiple stages, a choke coil in one stage may become magnetically coupled to a choke coil in the following stage due to the leakage flux described above. Such magnetic coupling can generate oscillations.

SUMMARY OF THE INVENTION

In view of the foregoing, it is an object of the present invention to provide a choke coil for broadband use including the microwave band that is capable of being densely mounted on a printed circuit board and that is capable of preventing oscillations generated by neighboring choke coils becoming magnetically coupled.

These objects and others will be attained by a choke coil comprising a coil having an insulated conducting wire wound in a coil shape; and a conducting ring having a centerline extending in the axial direction of the coil.

In a choke coil having this construction, the conducting ring can be disposed one on either end of the coil or only on one end of the coil Further, the ring and coil are arranged sequentially in a straight line. The distance between the coil and ring is set according to the intended use.

DESCRIPTION OF THE PREFERRED EMBODIMENTS

Figure 1:
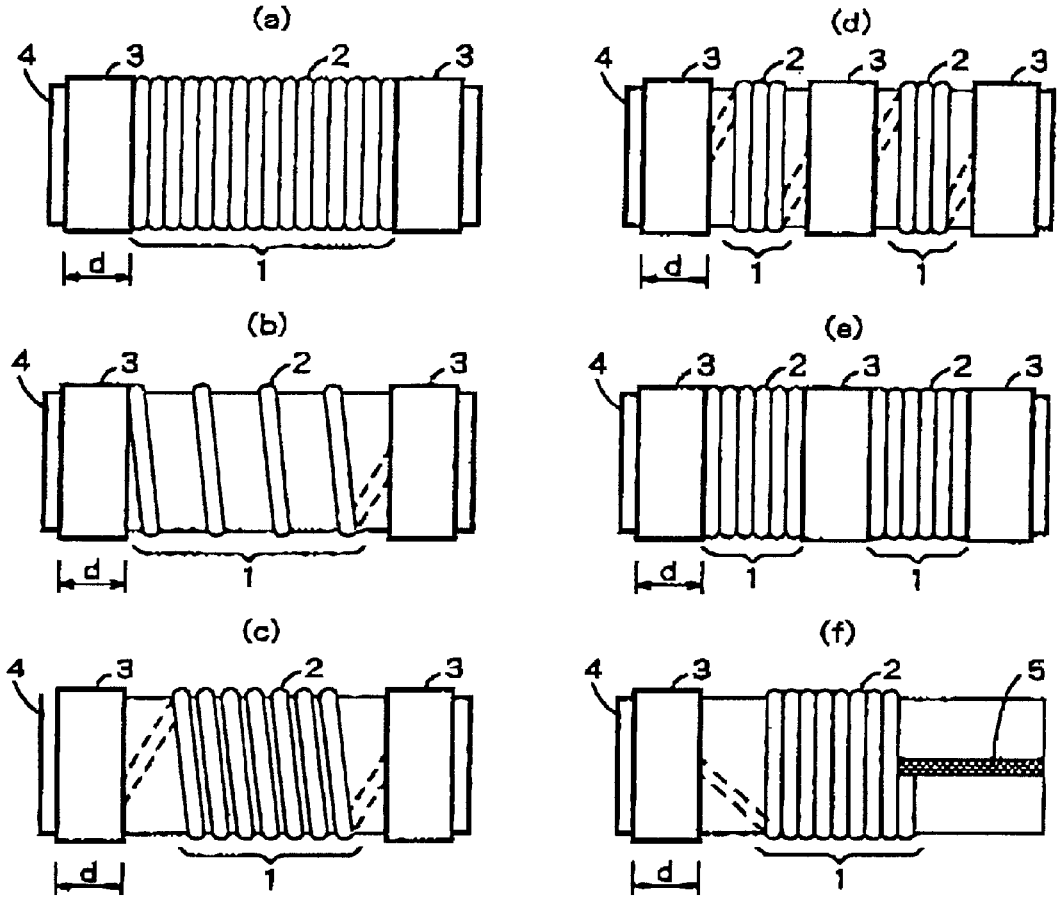
FIG. 1 includes several side views showing the construction of choke coils according to the preferred embodiment of the present invention.

A choke coil according to a preferred embodiment of the present invention will be described while referring to the accompanying drawings. FIG. 1 includes several side views showing the construction of choke coils according to the preferred embodiment of the present invention. These choke coils are mounted on printed circuit boards or the like.

As shown in the diagram, the choke coil is provided with a coil 1 formed by winding an insulated conducting wire 2 (in the present embodiment, the wire has been covered by an insulating coating), and a conducting ring 3 having a width d that is disposed on one or both ends of the coil 1. The ring 3 can also be formed at a width d by tightly winding a conducting wire stripped of its insulating coating. This type of ring is mounted on the printed circuit board with solder or the like, serving as an electrode terminal. A bar-shaped core 4 is inserted inside the coil 1. The core 4 is formed of ferrite material, a ceramic that is not deformed by solder during the mounting process, a glass highly resistant to heat, or the like. Viewed from its lengthwise end, the choke coil is shaped round, square, elliptical, or the like.

Therefore, the choke coil of the present embodiment comprises the coil 1 having a wound conducting wire 2 and the ring 3 having a centerline extending in the axial direction of the core 4.

Next, the general functions of the ring 3 will be described.

Figure 2:
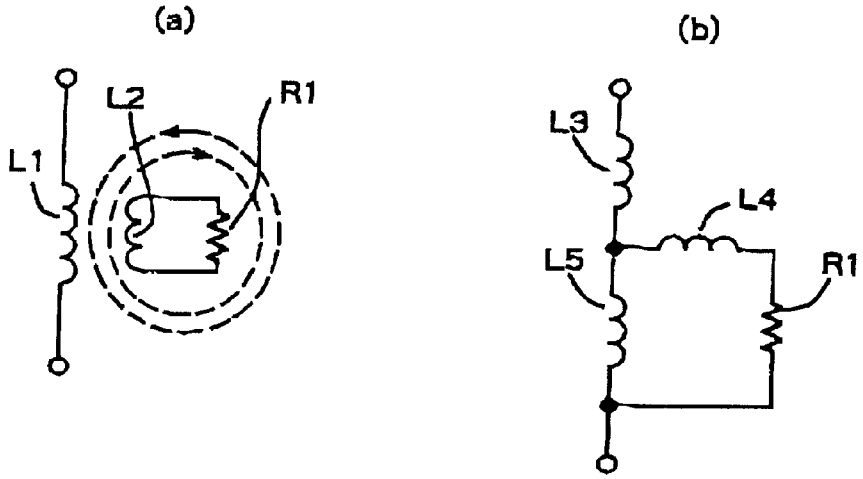
FIG. 2 includes circuit diagrams showing an equivalent circuit for the choke coils of FIG. 1.

FIG. 2 shows an equivalent circuit for the choke coil having the ring 3 as shown in FIG. 1. FIG. 2(*a*) shows an approximation of the equivalent circuit that accounts for an eddy current generated in the choke coil. This choke coil can be approximated with an inductance element L1, an inductance element L2 opposing the inductance element L1, and a resistor R1 connected to the inductance element L2. The inductance elements L1 and L2 generate magnetic fluxes in opposing directions.

Hence, the ring 3, which corresponds to the circuit comprising the resistor R1 and the inductance element L2, serves to decrease the magnetic flux formed by the coil 1, which corresponds to the inductance element L1. Accordingly, the ring 3 can reduce the amount of leakage flux from the coil 1; that is, the magnetic flux near the ring 3 of the choke coil.

A circuit such as that shown in FIG. 2(*b*) can represent the circuit shown in FIG. 2(*a*). The circuit in FIG. 2(*b*) includes an inductance element L3 and an inductance element L5 connected in series, and an inductance element L4 and the resistor R1 connected in series The latter series is connected in parallel with the inductance element L5. Here, L3=L1−L5 and L4=L2−L5. Hence, the ring 3 can perform the same role as a resistor connected in parallel to the coil The mutual inductance value M for inductance elements L1 and L2 above, where M=L5, is expressed by the following equation.

$$M = k\sqrt{L1 \cdot L2} \qquad \text{Equation 1}$$

The coupling coefficient k of the above equation can be set by varying the gap between the rings 3 and the coil 1, in order to decrease the Q-value of the coil 1. By adjusting the coupling coefficient kin this way, it is possible to adjust the leakage flux. The Q-value of the coil 1 can also be adjusted by varying the width d of the ring 3. Accordingly, the ring 3 is provided both for reducing the leakage flux of the coil 1 and setting an appropriate Q-value for the same.

Next, the features of each choke coil shown in FIGS. 1(*a*)–(*f*) will be described.

The choke coil of FIG. 1(*a*) is configured of a coil 1 formed with a tightly wound conducting wire 2. This choke coil is used for low-frequency applications. The choke coil of FIG. 1(*b*) is configured of a coil 1 formed by winding the conducting wire 2 at a large pitch. This choke coil is used for high-frequency applications. In the choke coil of FIG. 1(*c*), the conducting wire 2 is wound at a small pitch. Here, a gap is formed between the rings 3 and the coil 1. The Q-value of the coil 1 can be adjusted by varying the size of this gap.

The choke coil shown in FIG. 1(*d*) is configured with two coils 1 formed with a tightly wound conducting wire 2 and an additional ring 3 disposed between these coils 1. Further, a gap is formed between each of the coils 1 and the rings 3. The two coils 1 are connected in series via the ring 3. By disposing an additional ring 3 between the coils 1 and forming a gap between the coils 1 and rings 3 as described above, it is possible to reduce the degree of magnetic coupling between each coil 1.

As with the choke coil of FIG. 1(*d*), the choke coil of FIG. 1(*e*) is provided with an additional ring 3 between two coils 1. However, in this choke coil a gap is not formed between the coils 1 and the rings 3. With this configuration, it is also possible to reduce the degree of magnetic coupling between the coils 1.

The choke coils shown in FIGS. 1(*d*) and (*e*) are configured with two coils 1 and three rings 3 alternately connected in series. However, the present invention is not limited to this number of coils 1 and rings 3. A different number of coils 1 and rings 3 suitable for the intended frequency application of the choke coil can be connected alternately in series.

The choke coil shown in FIG. 1(*f*) includes a coil 1 formed of a tightly wound conducting wire 2 and a ring 3 disposed only on the left end of the coil 1. The ring 3 can be disposed on either end of the coil 1 depending on the application. By disposing only one ring 3 on the left end of the coil 1, it is possible to reduce the magnetic flux near that end. It is also possible to reduce magnetic flux near both ends of the coil 1 by connecting this choke coil in series with other types of choke coils shown in FIGS. 1(*a*)–(*e*). The choke coil of FIG. 1(*f*) is also provided with an electrode terminal 5 that is used for mounting the choke coil on a printed circuit board. This electrode terminal 5 is formed by removing the insulating coating from the end of the conducting wire 2.

The conducting wire 2 used in the coil 1 of each choke coil shown in FIGS. 1(*a*)–(*f*) is wound in a manner suitable for the intended frequency application of the choke coil.

Figure 3:
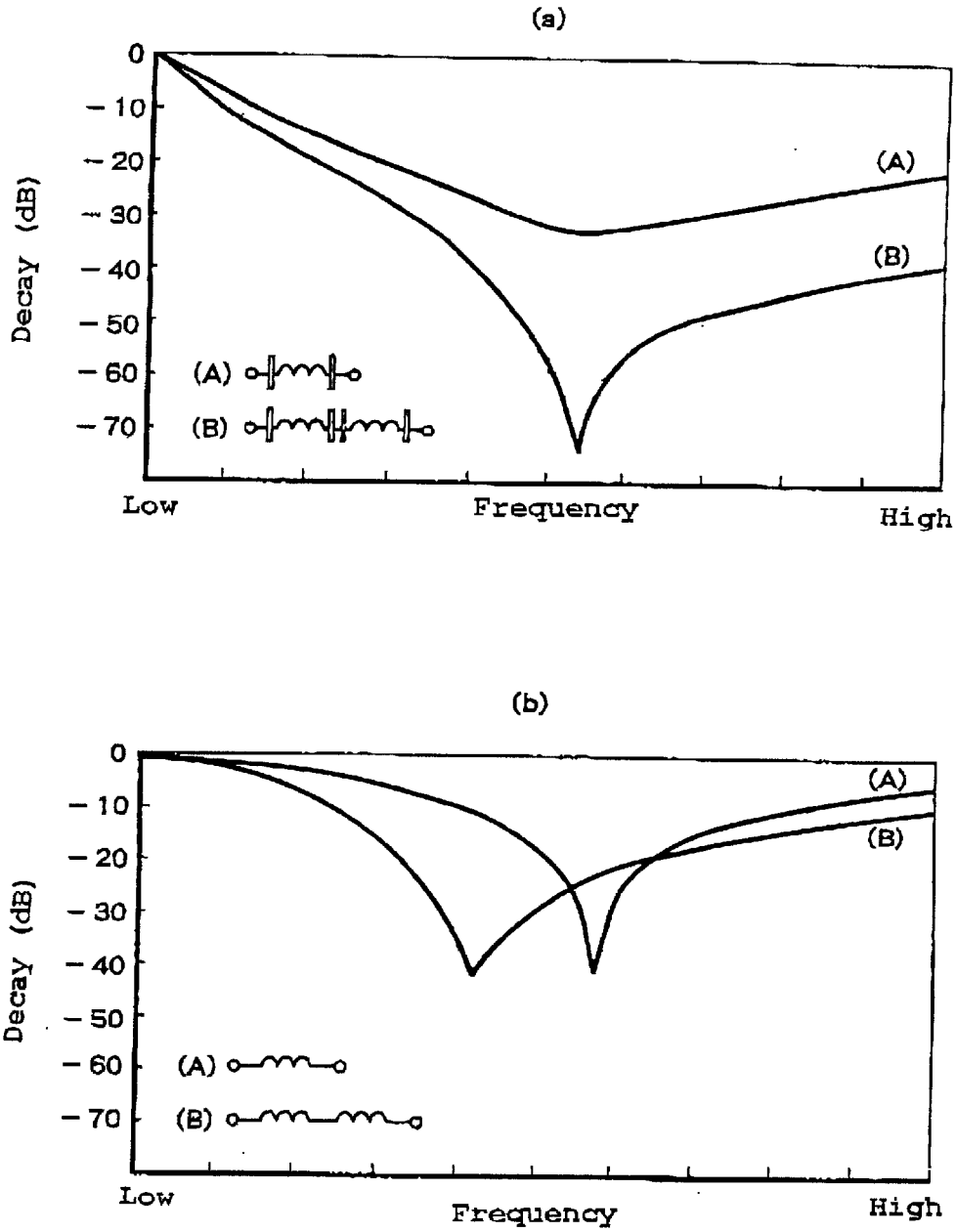
FIG. 3 includes graphs showing the decay properties of choke coils in relation to frequency.

FIG. 3 includes graphs showing the decay properties of choke coils in relation to frequency. FIG. 3(*a*) shows the characteristics when employing a choke coil shown in FIG. 1, while FIG. 3(*b*) shows the characteristics when employing a general inductor coil.

As shown in FIG. 3(*a*), (A) is the frequency characteristics when using a single choke coil of the present embodiment, while (B) is the frequency characteristics when connecting two choke coils with the characteristics (A) in close proximity. Since the Q-value of the coil 1 is adjusted to a suitable value by the ring 3, it can be seen that the characteristics (A) of FIG. 3(*a*) have a higher isolation (higher decay) across the broad band, than the frequency characteristics (A) when using the general inductor coil shown in FIG. 3(*b*).

The degree of magnetic coupling between choke coils can be reduced by the ring provided between the coils 1, as described above. Accordingly, movement in resonance frequency as in the characteristics (B) shown in FIG. 3(*b*) does not occur and the frequency characteristics (B) shown in FIG. 3(*a*) have an even higher isolation across the broad band than the frequency characteristics (A) shown in FIG. 3(*a*).

Figure 4:
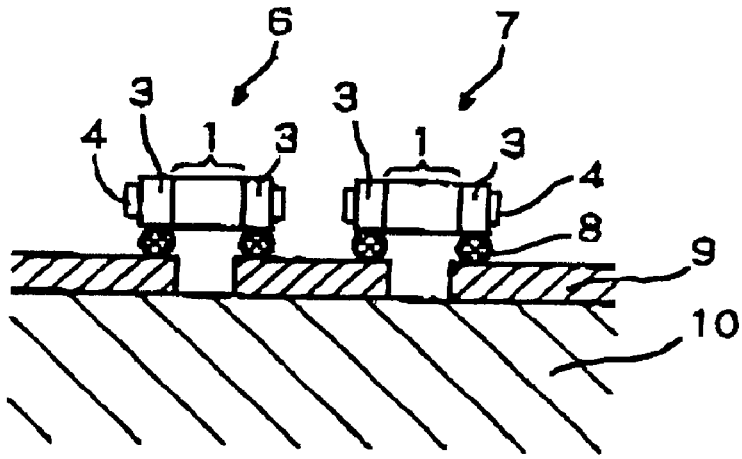
FIG. 4 is a side view showing the configuration of two choke coils in FIG. 1 mounted next to each other and in series on a substrate.

FIG. 4 is a side view showing a configuration of two choke coils connected in series on a printed circuit board Each choke coil is provided with a ring 3 on both sides of the coil 1.

As shown in FIG. 4, a conducting pattern 9 for wiring is formed on an insulating substrate 10. Choke coils 6 and 7 of FIG. 1 are soldered onto the conducting pattern 9 using a solder 8. The ring 3 provided on one or both ends of the coil 1 can decrease the leakage flux between the coils 1, that is, the magnetic flux near the ring 3, thereby lowering the Q-value of the coil 1.

With this configuration, interference can be eliminated between choke coils when connecting choke coils in FIG. 1 close together in series. As a result, it is possible to mount choke coils in a dense configuration on a printed circuit board. In addition to preventing oscillations generated by magnetic coupling between choke coils, these choke coils can function up to the microwave band.

Since these choke coils can be combined in series, they can be used on a printed circuit board to eliminate the problem of insufficient isolation. By combining choke coils described above that have different resonance frequencies, it is possible to adjust the frequency bands in which these choke coils can be used. Hence, the choke coils of the present invention can be used as broadband choke coils suitable for frequency ranges higher than the microwave band.

Since they can be used in various combinations, the choke coils of the present invention greatly improve productivity by eliminating the need to increase the types of choke coils manufactured.

In the embodiment described above, choke coils provided with a ring 3 on one end or both ends of the coil 1 have been described. However, the present invention is not limited to this configuration. The ring 3 can be disposed at any position in relation to the coil 1, providing the centerline of the ring 3 extends in the same direction as the core 4 that penetrates the coil 1.

Further, in the embodiment described above, the choke coil is provided with a core 4. However, the same effects of the present invention can be achieved with a choke coil having a hollow core.

As described above, the choke coils of the present invention can be densely mounted on a printed circuit board. Further, the present invention is capable of preventing oscillations generated by neighboring choke coils that become magnetically coupled. Choke coils of the present invention can be used for a broadband that includes the microwave bands.

What is claimed is:

1. A choke coil comprising:

a coil having an insulated conducting wire wound in a coil shape; and a conducting ring having a centerline extending in the axial direction of the coil.

2. A choke coil as recited in claim 1, wherein the conducting ring is disposed one on either end of the coil.

3. A choke coil as recited in claim 1, wherein the conducting ring is disposed on one end of the coil.

4. A choke coil as recited in claim 1, wherein the ring and coil are arranged sequentially in a straight line.

5. A choke coil as recited in any of claims 2 through 4, wherein the distance between the coil and ring is set according to the intended use.

* * * * *